United States Patent [19]

Malagola et al.

[11] Patent Number: 4,624,750

[45] Date of Patent: Nov. 25, 1986

[54] PROCESS FOR CORROSION PROTECTION OF A STEAM GENERATOR TUBE AND DEVICE FOR MAKING USE OF THIS PROCESS

[75] Inventors: Philippe A. Malagola, Paris; Jean-Marie J. Vassal, Plaisir, both of France

[73] Assignee: Framatome & Cie., Courbevoie, France

[21] Appl. No.: 739,252

[22] Filed: May 30, 1985

[30] Foreign Application Priority Data

May 30, 1984 [FR] France ..... 84 08550

[51] Int. Cl.[4] ..... C25D 7/04

[52] U.S. Cl. ..... 204/26

[58] Field of Search ..... 204/26

[56] References Cited

U.S. PATENT DOCUMENTS 3,673,073 6/1972 Tobey ..... 204/26

FOREIGN PATENT DOCUMENTS 1596030 7/1970 France ..... 204/26

2421359 10/1979 France ..... 204/26

2484875 12/1981 France ..... 204/26

*Primary Examiner*—T. M. Tufariello

*Attorney, Agent, or Firm*—Pollock, Vande Sande & Priddy

[57] ABSTRACT

Process for corrosion protection of a steam generator tube, in which a metal layer (10) compatible with the material of the tube (1) is deposited by electrolysis on the inner surface of the tube (1) after it is fixed in the tube plate (2), on either side of the face of the plate (2) in contact with the water to be vaporized, over a length which is appreciably greater than the transition zone (5) between the crimped part and the uncrimped part of the tube (1). The outer surface of the tube (1) may also be covered with a metal layer (12) before it is fixed in the tube plate (2). The invention applies, in particular, to steam generators of pressurized water nuclear reactors.

6 Claims, 6 Drawing Figures

PROCESS FOR CORROSION PROTECTION OF A STEAM GENERATOR TUBE AND DEVICE FOR MAKING USE OF THIS PROCESS

FIELD OF THE INVENTION

The invention relates to a process for corrosion protection of a steam generator tube.

BACKGROUND OF THE INVENTION

Steam generators in pressurized water nuclear reactors generally incorporate a bundle of U-shaped tubes the ends of which are fixed in a tube plate. This tube plate divides the steam generator into a zone receiving pressurized water which forms the fluid bringing its heat to the steam generator and a zone receiving feed water to be vaporized in the steam generator. The tube bundle is arranged in the part of the steam generator which receives the water to be vaporized, and the ends of each of the tubes pass through the plate over its entire thickness so as to be placed in communication with the zone of the steam generator which receives the pressurized water or primary fluid. This zone forms a water box made of two parts one of which receives the pressurized water and distributes it into the tubes of the bundle while the other collects the pressurized water which has circulated in the tubes, before it returns to the nuclear reactor vessel. The feed water is heated and vaporized in contact with the outer wall of the tubes of the bundle.

The tube plates of steam generators in pressurized water reactors are very thick and can reach or exceed 0.60 meter. The ends of each of the tubes of the bundle are fixed by crimping in the holes passing through the tube plate over its entire thickness. This operation, also called expansion rolling, consists in rolling the wall of the ends of the tubes introduced into the tube plate with the aid of a tool called an expanding roller incorporating rolling wheels which is moved within the tube in all its part situated within the tube plate. The ends of the tube are welded to the tube plate at their end which is flush with the face of this tube plate which comes into contact with the primary fluid. The other face of the tube plate is crossed by the tubes which enter the zone of the steam generator which receives the water to be vaporized.

The tubes of the bundle form a dividing wall between the primary radioactive fluid and the secondary fluid consisting of the feed water or its vapor. This vapor is led away towards the turbines associated with the nuclear reactor and situated outside the reactor building which forms the containment enclosure of the latter. It is thus very important that the tubes ensure a perfect separation between the primary fluid and the secondary fluid.

When the steam generator is brought into operation, this perfect separation of the fluids is ensured, the integrity of the tube walls and the quality of the welds having been checked. However, after some period of operation of the steam generator, this is no longer necessarily the case, since cracks or perforations may have appeared in some of the tubes, in particular under the effect of corrosion. Steam generators are, in fact, intended to be used for very long periods, of the order of forty years, and despite the corrosion resistance of the materials employed in their construction, an attack on the tubes, which are generally made of a nickel alloy, can take place in some zones.

In particular, it has been found that the part of the tubes which is situated in the vicinity of the tube plate face which comes into contact with the water to be vaporized is subjected to greater corrosion than the other parts of the tube. This, in fact, is the part of the tube which contains the transition zone between the part which is distorted during the expanding operation and the undistorted part of the tube. In an operating reactor the primary fluid is at a temperature of approximately 325° C. and a pressure of 155 bars. This fluid consists of demineralized water containing variable quantities of boron in the form of boric acid which absorbs neutrons and permits control of reactor power, and lithium hydroxide to maintain the pH of the primary fluid at a value which permits the corrosion to be limited. However, in the transition zone, where the residual stress concentration is high, after expansion rolling, in particular in the internal surface layer of the tube, corrosion of this tube takes place in contact with the primary fluid at a high temperature and high pressure, this corrosion being even capable of resulting in perforation or cracking of the tube, and consequently in entry of the primary fluid into the secondary fluid.

Attempts have been made to improve the corrosion resistance of steam generator tubes, in the transition zone, by relieving the stresses in the tube by diametral expansion. Thus, tools have been designed which make it possible to carry out rapidly and automatically the stress-relieving of the outer wall of the tubes of a steam generator in their transition zone. Since the expansion rolling of the tubes is carried out over the entire part of the tube within the tube plate, the transition zone is situated in the vicinity of the tube plate face which comes into contact with the feed water to be vaporized. This stress-relieving operation, which must be carried out on the ends of each of the tubes in the steam generator, is relatively time-consuming, even when tools whose operating cycle is entirely automatic are employed. In fact, a steam generator of a pressurized water nuclear reactor contains a very large number of tubes, possibly five thousand.

Furthermore, after the operation of relieving stresses in the outer skin of the tube, the stress concentration remains relatively high in the inner skin of the tube. Sensitivity to corrosion therefore remains higher in this zone of the tube close to the tube plate face in contact with the water to be vaporized.

The feed water is demineralized water containing hydrazine and ammonia for its conditioning in order to reduce its corrosive power. However, this feed water, which is subjected to phase changes and which is recycled to the steam generator after being condensed, attacks some parts of the secondary circuit and carries corrosion products which tend to accumulate on the upper face of the tube plate, on the secondary side of the steam generator. These corrosion products are deposited in the form of sludges which contain essentially magnetite and can accumulate to a height of several centimeters on the upper face of the tube plate, during the operation of the steam generator.

The part of the tubes of the bundle which is in the vicinity of this face of the tube plate suffers increased corrosion on its outer surface owing to the accumulation of impurities in contact with the tube, and in particular in the gap which can be present between the tube and the end of the hole in the tube plate, owing to poor circulation of the secondary fluid and to the poor heat exchange of this fluid in this zone, and finally because of the creation of an electrochemical environment which is unfavorable for the corrosion resistance of the tube.

To overcome these disadvantages, devices have been suggested which permit the layer of impurities on the upper face of the tube plate to be eliminated more or less completely. Despite this, corrosion of the tube on its outer surface, in the vicinity of the upper face of the tube plate, can be high and can increase the seriousness of the corrosive effect of the primary fluid inside the tubes.

There is also known, from French Pat. No. 2,484,875, a process for leakproof fixing of a tube in a tube plate, in which use is made of a leaktight sleeve placed around the tube in its part entering the tube plate, before expansion rolling, which makes it possible, in particular, to eliminate the residual annular space between the tube and the outlet end of the hole in the tubular plate. However, such a process complicates the expanding operations, because it requires a sleeve to be fitted around each of the ends of the tube before they are fitted in the tube plate. Finally, this process provides no protection for the inner surface of the tube.

SUMMARY OF THE INVENTION

The object of the invention is consequently to offer a process for corrosion protection of a steam generator tube fixed by crimping in a thick tube plate between the face of the tube plate coming into contact with the fluid delivering heat to the steam generator, in the vicinity of which face the end of the tube is welded to the plate, and the other face of the tube plate through which the tube enters the zone of the steam generator receiving the water to be vaporized, this protective process being highly efficient and simple to implement.

To this end, a metal layer compatible with the material of the tube is deposited by electrolysis on the inner surface of the tube, after it is fixed in the tube plate by crimping and, if appropriate, stress-relieved, on either side of the face of the tube plate in contact with the water to be vaporized, over a length which is appreciably greater than the length of the transition zone between the part distorted by the crimping and the undistorted part of the tube.

According to a preferred embodiment, a coating of the outer surface of the tube is also produced on either side of the face of the tube plate in contact with the water to be vaporized, before the tube is introduced into the tube plate and crimped therein.

BRIEF DESCRIPTION OF THE DRAWINGS

In order that the invention may be more clearly understood, a description will now be given, by way of non-limiting example, with reference to the attached drawings, of several embodiments of the invention.

DETAILED DESCRIPTION

Figure 1A:
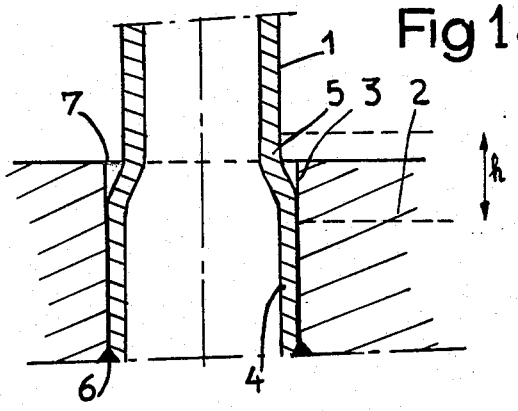
FIG. 1*a* is a view in cross-section through a plane of symmetry of the part situated in the vicinity of the transition zone of a tube fitted and fixed by crimping in a tube plate.

FIG. 1*a* shows a tube 1 one end of which is introduced into a hole 3 in a tube plate 2 of a diameter which is slightly greater than the diameter of the tube 1.

After the expanding operation, the end 4 of the tube introduced into the tube plate has been widened diametrally and rolled against the wall of the hole 3 so that the thickness of the tube in this part 4 is slightly reduced. The end of the tube situated at the side of the lower face of the tube plate 2 which comes into contact with the primary fluid of the reactor is fixed in the tube plate in a leaktight manner by an annular weld 6.

The transition zone 5 between the distorted part 4 of the tube 1 and the undistorted part extends on either side of the upper face of the tube plate 2 which comes into contact with the water to be vaporized. This transition zone 5 has a height h.

Figure 1B:
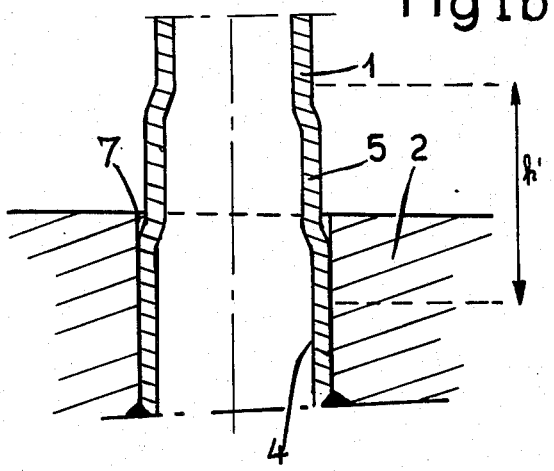
FIG. 1*b* is a view in cross-section of the part of a tube in the vicinity of its transition zone, after fitting and crimping in a tube plate and after stress-relieving.

FIG. 1*b* shows the tube 1 whose part 4 is fixed by expansion rolling in the tube plate 2, after a stress-relieving operation which has enabled the stresses in the transition zone 5 to be reduced, while lengthening appreciably this transition zone whose height h′ is much greater than the height h of the corresponding zone of the tube shown in FIG. 1*a*. The stress-relieving operation consists of a diametral widening of the tube in its zone 5 which makes it possible to close up partially the space 7 remaining between the tube and the hole 3 in the tube plate 2 in the vicinity of its upper outlet face, to lengthen the transition zone 5 and to reduce the stresses, in particular in the outer skin of the tube, in this transition zone 5.

FIGS. 1*a* and 1*b* show the intermediate state and the final state respectively of a steam generator tube fixed in the tube plate by expansion rolling, and then stress-relieved.

Figure 2:
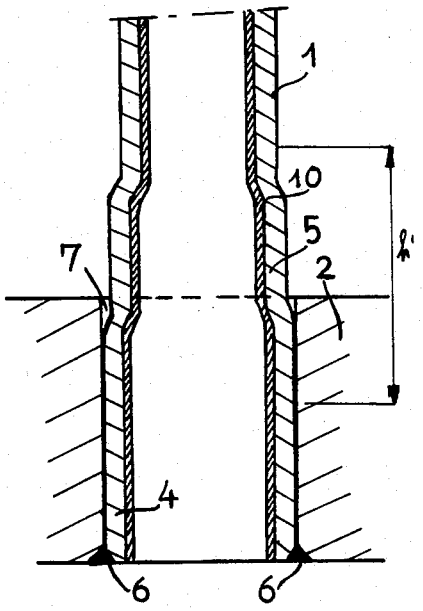
FIG. 2 is a view in cross-section through a plane of symmetry of the tube shown in FIG. 1*b*, after implementation of the process according to the invention, by production of an internal electrolytic deposit.

In FIG. 2, the same tube is shown after the process for corrosion protection according to the invention has been carried out.

Tube 1 consists of a variety of nickel alloy containing chromium and iron. Tube plate 2 is made of lightly alloyed steel.

The lower face of the tube plate 2 which is flush with the end of part 4 of the tube 1 which is welded to the plate 2 is intended to come into contact with the primary fluid when the steam generator is in operation.

The upper face of the tube plate 2 which is crossed by the part of the tube entering the upper zone of the steam generator is intended to come into contact with the water to be vaporized.

In accordance with the process for corrosion protection according to the invention, a nickel deposit 10 has been produced on the inner surface of the tube on either side of the upper face of the tube plate 2, over a length which is appreciably greater than the length of the transition zone 5 of height h′.

In the embodiment shown in FIG. 2, the median part of the internal electrolytic coating layer 10 is in the vicinity of the upper face of the tube plate 2 and its lower end in the vicinity of the end of part 4 of the tube 1 fixed by welding 6 to the lower face of the tube plate. The overall length of this zone 10, for a tube plate with a thickness which is nominally equal to 0.60 of a meter, is more than a meter.

The thickness of this electrolytic coating of nickel 10 is of the order of a tenth of a millimeter, the tube having a diameter close to twenty millimeters.

During the operation of the steam generator, the primary fluid, at a high pressure and high temperature, which circulates inside the tube 1 does not come into direct contact with the inner surface of the tube 1 in its transition zone 5, the nickel layer 10 forming the inner skin of the tube in this zone. This layer 10 has a low residual stress concentration and therefore can resist corrosion by the primary fluid, under the operating conditions of the steam generator.

The inner skin of the tube 1 having a high residual stress concentration has thus been replaced by a layer having a low stress concentration, which resists corrosion, and insulates the inner surface of the tube from the primary fluid at high pressure and high temperature.

Figure 3:
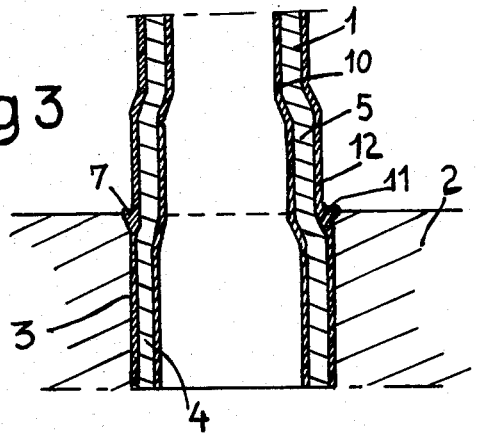
FIG. 3 is a view in cross-section through a plane of symmetry of the part of a steam generator tube in the vicinity of its transition zone, this tube being protected internally and externally by electrolytic deposits.

FIG. 3 shows a tube 1 fixed by crimping in a tube plate 2 incorporating, as before, an internal electrolytic nickel layer 10 over a height which is appreciably greater than the height of the transition zone 5, on either side of the upper face of the tube plate 2. In addition, the tube incorporates an outer layer of electrolytic nickel 12 which has been deposited on the tube before the introduction of this tube in the hole 3 in the tube plate and before part 4 of the tube has been expanded.

During the expansion rolling, a part of the outer coating layer 12 of nickel has been driven into the annular space 7 remaining between the tube 1 and the hole 3 in the tube plate 2, to form a bead 11 filling the annular space 7.

The deposition of electrolytic nickel on the outer surface of the tube may be carried out by any known process for electrolytic coating of the outer surface of a tube.

The outer surface of the ends of all the tubes in the bundle is coated with a layer of nickel with a thickness of the order of one-tenth of a millimeter, from the end of the tube over a length which is appreciably greater than the thickness of the tube plate, up to twice this thickness. The end of the tube is then introduced into the corresponding hole 3 in the tube plate 2, and is then expanded and stress-relieved as before. Finally, the inner layer 10 is deposited electrolytically inside the tube by an internal coating device which may be of the type shown in FIGS. 4 or 5.

Figure 4:
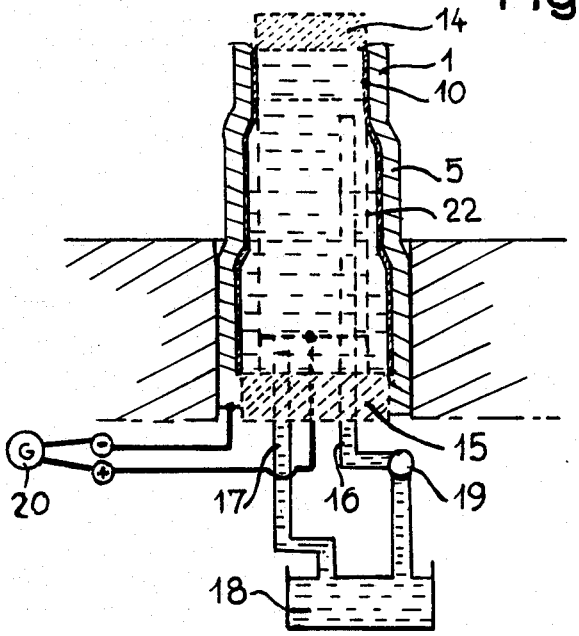
FIG. 4 is a view in cross-section of a device permitting electrolytic deposition inside a steam generator tube, in position in this tube.

FIG. 4 shows the device for electrolytic coating with nickel arranged inside the tube 1, for a coating operation leading to the production of a layer 10 over a length of the tube which is appreciably greater than the length of the transition zone 5.

The device incorporates an upper plug 14 and a lower plug 15, made of plastic, whose diameters permit the tube to be plugged in a leaktight manner in its unwidened part and in its widened part, respectively. The plugs 14 incorporate hooking means which enable them to be fitted inside the tube from the lower face of the tube plate. Two conduits 16 and 17 pass through the lower plug 15, making it possible, respectively, to feed the electrolyte into the inner volume of the tube included between the plugs 14 and 15 and to remove this electrolyte so that it can be collected in a storage vessel 18. A pump 19 enables the electrolyte to be conveyed from the storage vessel 18 to the inner volume of the tube between the plugs 14 and 15. Adjustment of the composition of the electrolyte for nickel deposition can be made in the storage vessel 18.

A perforated tubular electrode 22 with a diameter which is slightly smaller than the diameter of the tube 1 is fixed on the plug 15, this electrode being connected to the positive pole of a direct current generator 20, whose negative pole is connected to the tube 1.

Since the strength of the current delivered by the generator 20 is controlled at a fixed value, the thickness of the nickel deposit 10 depends only on the time for which the current is passed through the electrolyte. A coating layer 10 having a perfectly determined thickness can thus be produced inside the tube 1.

The length of the zone coated by the nickel layer 10 is determined by the position of the plugs 14 and 15, the fitting of which is monitored with the aid of a gauge rod at the time when the device is installed, and by the position and size of the tubular electrode 22.

Figure 5:
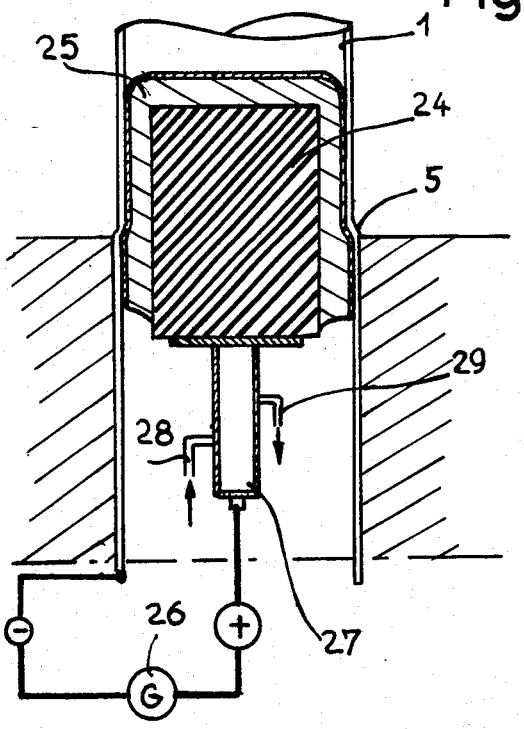
FIG. 5 is a view in cross-section of a device for producing an internal deposit in the transition zone of a tube, according to an alternative embodiment.

FIG. 5 shows an alternative embodiment of the electrolysis device which makes it possible to obtain an inner layer of nickel coating in a tube fixed by crimping in a tube plate.

Instead of a perforated hollow cylindrical electrode 22 made of metal or of a precious metal such as platinum, as employed in the device shown in FIG. 4, use is made of a graphite anode 24 of a diameter which is slightly smaller than the diameter of the tube 1, surrounded by a conductive and porous plug 25 impregnated with electrolyte. The anode 24 is connected to the positive pole of the direct current generator 26 through the intermediacy of a hollow electrode carrier 27, the negative pole of the generator being connected to the tube 1. The hollow electrode carrier 27 is cooled by circulation of coolant delivered to the electrode carrier via a tube 28 and removed via a tube 29.

By means of the device shown in FIG. 5, a nickel deposit 10 can be produced in the transition zone 5 of the tube and on either side of this zone over a sufficient length, either by providing a plug 25 of a sufficient length or by moving the electrode 24 and the plug inside the tube in a controlled manner with a time of electrolysis which is sufficient to produce a nickel layer of the required thickness in the tube.

In the case where use is made both of an inner layer for corrosion protection and an outer layer on the tube, the inner layer should be produced after crimping and, if appropriate, after stress-relieving of the tube, while the outer layer should be produced on the tube before it is introduced into the tube plate, crimped and, if appropriate, stress-relieved.

The principal advantages of the process according to the invention are to implement in a very simple manner an extremely efficient protection of the tube against corrosion by the primary fluid in the transition zone which is the most sensitive to this corrosion, owing to the accumulation of stresses, and to produce this protection without modification of the metallurgical or mechanical state of the tube.

In the case where an external coating is also produced on the tube before it is fixed in the tube plate, efficient protection against corrosion by the secondary fluid is thus obtained, in particular in the zone where the tube emerges from the face of the tube plate which is in contact with the secondary fluid.

The invention is not restricted to the embodiments which have been described; on the contrary, it includes all the alternative forms.

Thus, instead of a nickel deposit, a deposit of another metal may be employed, provided that this metal is compatible with the material of which the tube to be coated is made.

It is also possible to conceive other devices for the internal coating of the tube after expansion rolling and stress-relieving.

Moreover, the metal deposit produced on the inner or outer face of the exchanger tube can be produced by means other than electrolytic deposition, such as by chemical or physico-chemical methods for metallizing.

Finally, the process according to the invention applies not only in the case of steam generators of pressurized water nuclear reactors, but also in the case of any steam generator incorporating tubes crimped in a thick tube plate whose inner surface comes into contact with a fluid which may be corrosive under the conditions of use of the steam generator.

We claim:

1. Process for corrosion protection of a steam generator tube (1) fixed by crimping in a thick tube plate (2) between the face of the tube plate coming into contact with the fluid delivering heat to the steam generator in the vicinity of which face the end (4) of the tube (1) is welded to the plate (2) and the other face of the tube plate (2) through which the tube (1) enters the zone of the steam generator receiving the water to be vaporized, in which a metal layer (10) compatible with the material of the tube (1) is deposited by electrolysis on the inner surface of the tube (1) after it is fixed in the tube plate (2) by crimping on either side of the face of the tube plate (2) in contact with the water to be vaporized, over a length which is appreciably greater than the length of the transition zone (5) between the part (4) distorted by the crimping and the undistorted part of the tube (1).

2. Process for corrosion protection as claimed in claim 1, wherein, before the tube is introduced into the tube plate (2), crimped and stress-relieved, a layer of metal (12) compatible with the material of the tube (1) is deposited on the outer surface of this tube, in a zone corresponding to the zone of this tube (1) situated on either side of the face of the tube plate (2) coming into contact with the water to be vaporized, over a length which is substantially greater than the length of the transition zone (5).

3. Process for protection as claimed in claim 1, wherein the tube (1) is made of nickel alloy and the metal layer (10) deposited by electrolysis consists of nickel.

4. Process for protection as claimed in claim 1, wherein the zone of the inner surface of the tube coated with an electrolytic metal layer (10) extends from a zone close to the tube end (1) welded to the tube plate to a zone situated appreciably above the face of the tube plate (2) coming into contact with the water to be vaporized.

5. Process for protection as claimed in claim 4, wherein the zone of the inner surface of the tube (1) coated with an electrolytic metal layer (10) has a length which is substantially equal to or twice the thickness of the tube plate (2).

6. Process for protection as claimed in claim 2, wherein the electrolytic metal layer (12) deposited on the outer surface of the tube (1) has a thickness which is sufficient to fill the annular space (7) between the end of the tube (1) situated in the vicinity of the face of the tube plate (2) coming into contact with the water to be vaporized and this tube plate (2), after crimping and stress-relieving of the tube (1).

* * * * *